US008677565B2

(12) United States Patent
Vanini

(10) Patent No.: US 8,677,565 B2
(45) Date of Patent: Mar. 25, 2014

(54) HINGE FOR DOORS OF DOMESTIC APPLIANCES SUCH AS OVENS, DISHWASHERS OR THE LIKE

(71) Applicant: Nuova Star S.p.A., Zola Predosa (IT)

(72) Inventor: Marco Vanini, Bologna (IT)

(73) Assignee: Nuova Star S.p.A. (IT)

( * ) Notice: Subject to any disclaimer, the term of this patent is extended or adjusted under 35 U.S.C. 154(b) by 0 days.

(21) Appl. No.: 13/827,832

(22) Filed: Mar. 14, 2013

(65) Prior Publication Data

US 2013/0291337 A1 Nov. 7, 2013

(30) Foreign Application Priority Data

May 4, 2012 (IT) ..... BO2012A0244

(51) Int. Cl.
*E05F 1/08* (2006.01)

(52) U.S. Cl.
USPC ..... 16/286

(58) Field of Classification Search
USPC ..... 16/286, 287, 257, 260, 261, 263, 323, 16/324; 49/386, 389; 126/191, 192, 194
See application file for complete search history.

(56) References Cited

U.S. PATENT DOCUMENTS 4,794,669 A * 1/1989 Sanders ..... 16/341
7,275,283 B2 * 10/2007 Kistner et al. ..... 16/286
7,610,656 B2 * 11/2009 Vanini ..... 16/286
7,721,388 B2 * 5/2010 Lee ..... 16/286
2010/0229344 A1 9/2010 Donoho
2010/0251521 A1 * 10/2010 Donoho ..... 16/343
2010/0257698 A1 * 10/2010 Vanini ..... 16/233
2013/0214663 A1 * 8/2013 Marzorati ..... 312/400

FOREIGN PATENT DOCUMENTS

DE 4105274 A * 11/1991
EP 1302150 4/2003
EP 1847670 10/2007
WO 2005108724 11/2005

OTHER PUBLICATIONS

Italian Search Report dated Dec. 18, 2012 from counterpart application.

* cited by examiner

*Primary Examiner* — Chuck Mah
(74) *Attorney, Agent, or Firm* — Timothy J. Klima; Shuttleworth & Ingersoll, PLC

(57) ABSTRACT

A hinge for appliances includes a lever and a box-shaped body having a bottom wall and two side walls. The lever and the body, one of which is fixable to a frame of the appliance and the other to a door, are tiltably hinged to each other by a first pin to make the door movable between open and closed positions. The hinge includes an elastic mechanism located at least partly inside the body for producing an elastic reaction force which opposes opening of the door, a connecting rod hinged to a first end of the lever, a tie rod hinged to the connecting rod and connected to the elastic mechanism, and a pivot pin for the tie rod and the connecting rod, slidable with its ends in respective guides formed in the side walls of the body when the door is opened and closed.

9 Claims, 3 Drawing Sheets

FIG. 3
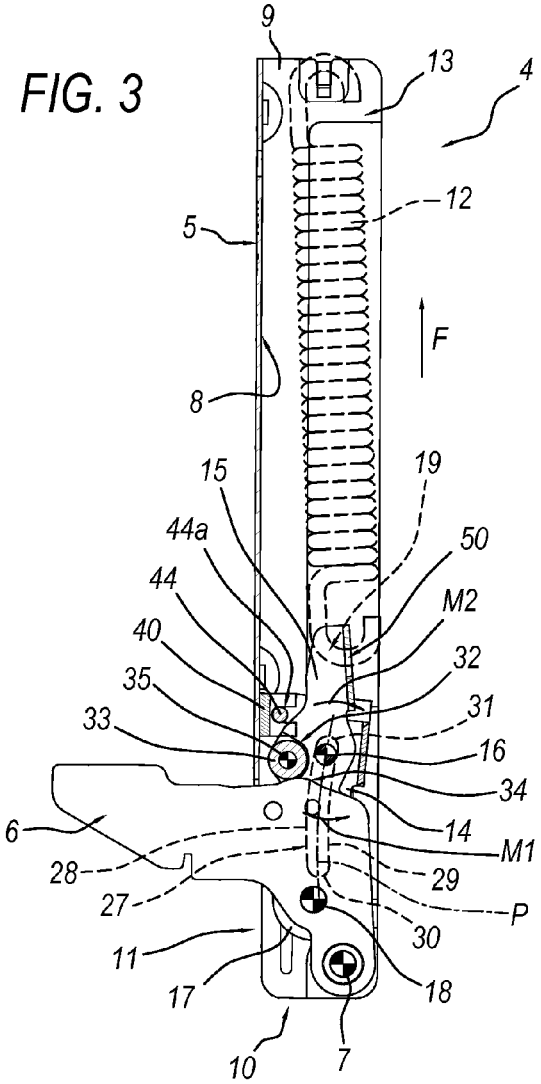
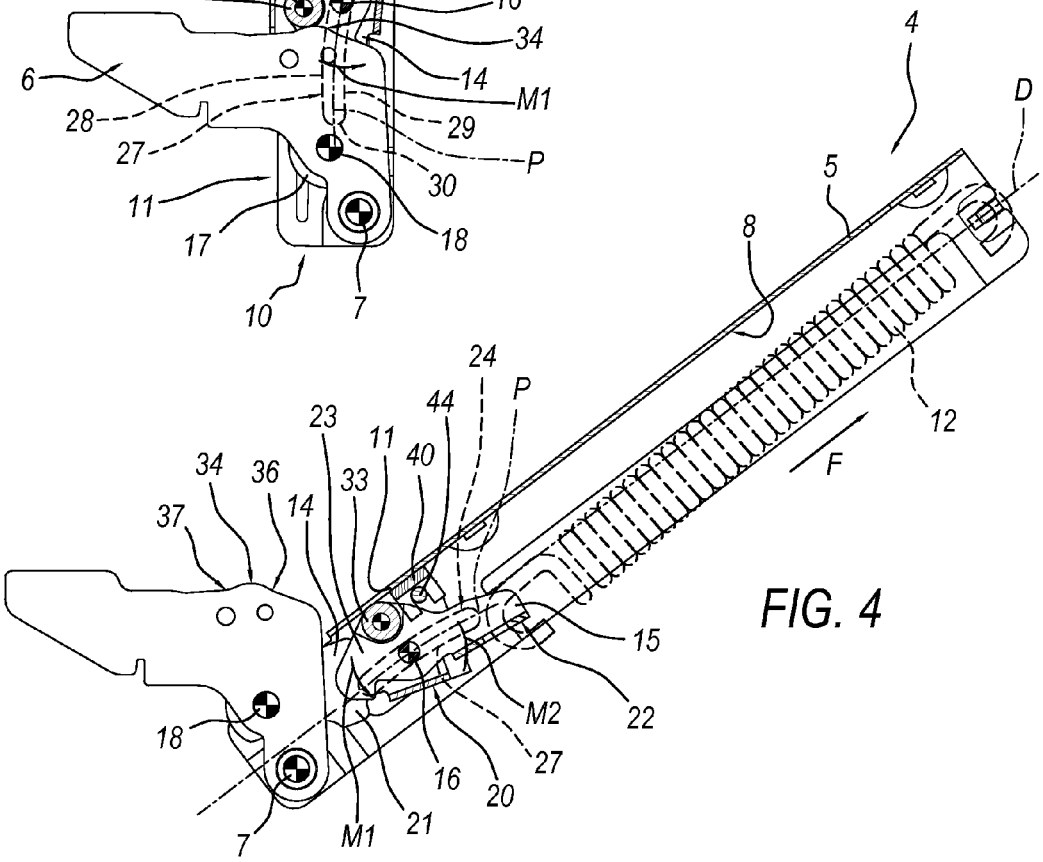
FIG. 4

HINGE FOR DOORS OF DOMESTIC APPLIANCES SUCH AS OVENS, DISHWASHERS OR THE LIKE

This application claims priority to Italian Patent Application BO2012A000244 filed May 4, 2012, the entirety of which is incorporated by reference herein.

BACKGROUND OF THE INVENTION

This invention relates to a hinge for doors.

More specifically, this invention relates to a hinge used for connecting the doors of domestic appliances to the respective supporting structures.

This specification describes the invention with reference to an oven purely by way of example.

Hinges of this kind are normally made up of two distinct parts, the first part being a lever fixed to the oven structure on one side of the oven opening, whilst the second part is fixed to one edge of the oven door which can thus be tilt opened with respect to the opening.

These prior art hinges are equipped with means for blocking the door in the closed position in order to stop it from opening spontaneously.

One prior art embodiment of these blocking means comprises a roller which engages a cam profile in the proximity of the closed position.

Inside the box-shaped body, the hinges have an elastic element which is interposed between the two hinge parts and which opposes the rotation of the door when the door is being opened.

The elastic element also acts on the roller to guarantee that the roller engages the cam profile and that the door is blocked in the closed position.

Also known is the use of a bar and connecting rod to connect the elastic element to the lever and to the roller of the blocking means.

The bar and connecting rod are also located inside the box-shaped body and are connected to it by a pin.

When the door is being opened and closed, the bar and connecting rod are movable relative to the box-shaped body and to allow this movement, the pin slidably engages a guide which is formed on the box-shaped body.

The disadvantage of these hinges is that, over time, the guide is subject to wear.

In effect, during use, the guide groove is subjected to stress by the sliding action of the pin.

This stress leads to wear of one or more parts of the guide.

Wear eventually leads to the roller not engaging the cam profile correctly when the door is being closed.

Failure of the roller to engage the cam profile properly means that the door is not blocked correctly in the closed position, with the risk of unwanted, spontaneous opening.

SUMMARY OF THE INVENTION

This invention therefore has for an aim to provide a hinge for doors of domestic appliances, such as ovens, dishwashers or the like, which overcomes the above mentioned disadvantages of the prior art.

The technical purpose indicated and the aim specified are substantially achieved by a hinge for doors of domestic appliances, such as ovens, dishwashers or the like, comprising the technical features set out in independent claim 1.

BRIEF DESCRIPTION OF THE DRAWINGS

These and other innovative features of the invention, as well as the advantages thereby achieved, will become more apparent from the following detailed description of a preferred, and hence non-limiting embodiment of the invention, with reference to the accompanying drawings, in which:

FIGS. 3 to 5 are side views, with some parts cut away in order to better illustrate others, of the hinge of FIG. 2 in different operating configurations;

DESCRIPTION OF THE PREFERRED EMBODIMENTS

Figure 1:
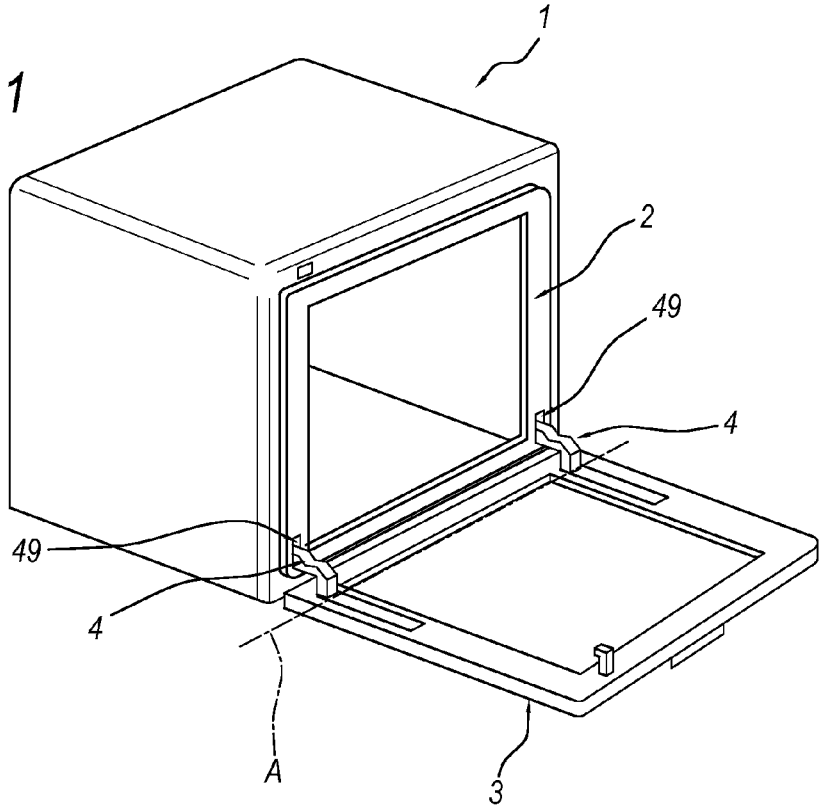
FIG. 1 is a schematic perspective view from above of an oven with a door connected to it by two hinges made in accordance with this invention.

With reference to FIG. 1, the numeral 1 denotes in its entirety an oven comprising a frame 2 and a door 3, the latter being connected to the frame 2 by a pair of hinges 4, each located on one side of the access opening of the oven 1, so as to allow the door 3 to be tiltably rotated about an axis A.

The hinge 4 of this invention comprises a box-shaped body 5 and a lever 6 which are connected to each other by a first pin 7 to make the lever 6 and the box-shaped body 5 tiltably movable relative to each other.

With reference in particular to FIG. 1, the lever 6 is fixed to the frame 2 of the oven 1, whilst the box-shaped body 5 is fixed to the door 3, in such a way that the door 3 is movable relative to the frame 2 between an open position and a closed position.

The lever 6 is solidly inserted into a seat, labeled 49 in the drawing, formed in the frame 2 of the oven 1.

Further, the first pin 7 defines a first axis B of relative rotation of the box-shaped body 5 and lever 6. Thus, the first axes B of each hinge 4 substantially coincide and define the axis A of tilting rotation of the door 3.

The box-shaped body 5 comprises a bottom wall 8 and two side walls 9. More specifically, the side walls 9 are opposed and parallel to each other and at right angles to the bottom wall 8. The box-shaped body 5 is elongate along a direction D and the walls 8 and 9 define a cross section of it which is substantially in the shape of a U.

At its first end 10, the box-shaped body 5 has an aperture 11 through which the lever 6 passes when the door 3 is turned about the first axis B.

The hinge 4 comprises a helical spring 12, preferably metallic, constituting elastic means for the hinge 4 adapted to produce an elastic reaction force, indicated by the arrow F in FIG. 3, which opposes the opening of the door 3.

The spring 12 is at least partly housed in the box-shaped body 5. In the embodiment illustrated in the drawings, the spring 12 is connected to a second end 13 of the box-shaped body 5, opposite the first end 10.

Advantageously, the spring 12 prevents the door 3 from opening too quickly under its own weight. The elastic reaction force generated by the spring 12 also makes it easier to close the door 3 because it reduces the force necessary to close it.

The hinge 4 also comprises a connecting rod 14 and a tie rod 15 pivoted to each other by a pivot pin 18.

The connecting rod 14 is hinged at a first end 17 to the lever 6 through the agency of a second pin 18. The tie rod 15 is connected to a second end 19 of the spring 12.

The connection of the spring 12, between the box-shaped body 5 and the tie rod 15, is such as to subject it to compressive stress. This causes the spring 12 to generate the above mentioned elastic reaction force in the direction of the arrow F.

As described better below, when the door 3 is being opened and closed, the tie rod 15 and the connecting rod 14 are movable relative to the box-shaped body 5. More specifically, the tie rod 15 and the connecting rod 14 move translationally relative to the box-shaped body 5 along a direction substantially parallel to the direction D of extension of the box-shaped body 5.

The connecting rod 14 comprises two side walls 21 which are opposed and, preferably, parallel to each other. The connecting rod 14 comprises a bottom wall 20 extending across the side walls 21 and at right angles to them.

The tie rod 15, too, comprises two side walls 23 which are opposed and, preferably, parallel to each other. The tie rod 15 comprises a bottom wall 22 extending across the side walls 23 and at right angles to them. Further, the spring 12 is connected to the tie rod 15 by way of a hole 50 made in the bottom wall 22.

Figure 2:
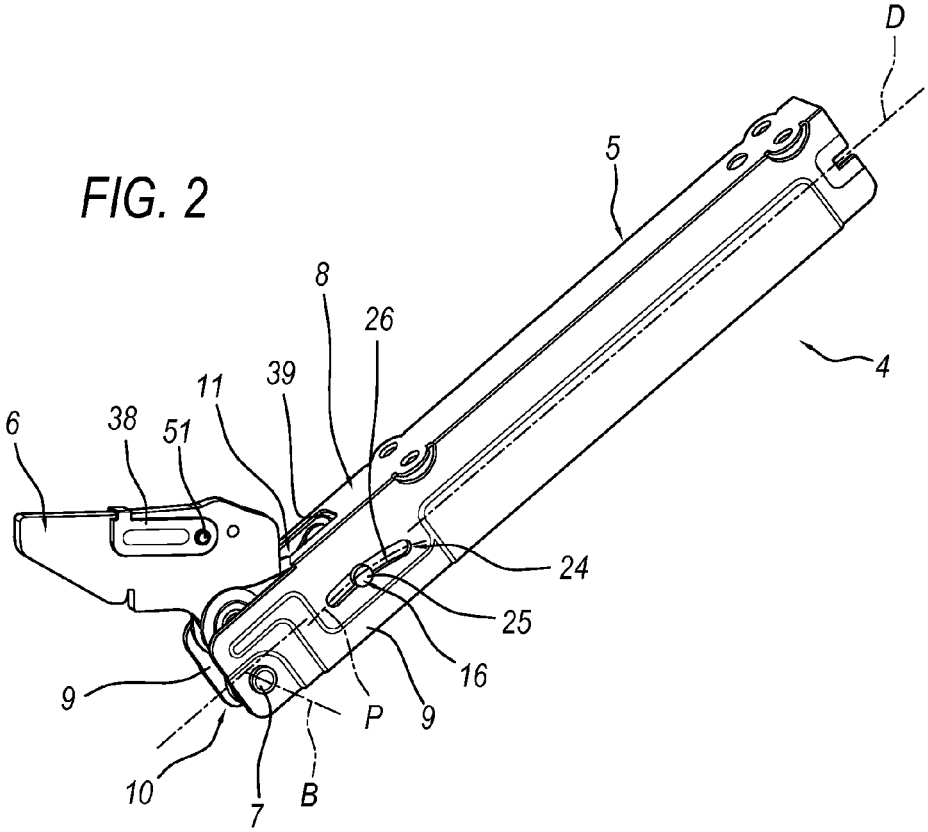
FIG. 2 is a perspective view of a hinge according to this invention.

With reference to FIG. 2, the box-shaped body 5, at each of its side walls 9, has a guide 24 and when the door 3 of the oven 1 is being opened and closed, the ends 25 of the pivot pin 16 are slidable in a respective guide 24.

The guides 24 define, for the pivot pin 16, a predetermined slide path P described in more detail below.

Each of the guides 24 is defined by a slot 26 formed on the respective side wall 9 of the box-shaped body 5. Each slot 26 has a closed profile defined by a first stretch 28 and a second stretch 29, and by a third stretch 30 and a fourth stretch 31 which join the first stretch 28 to the second stretch 29.

Figure 9:
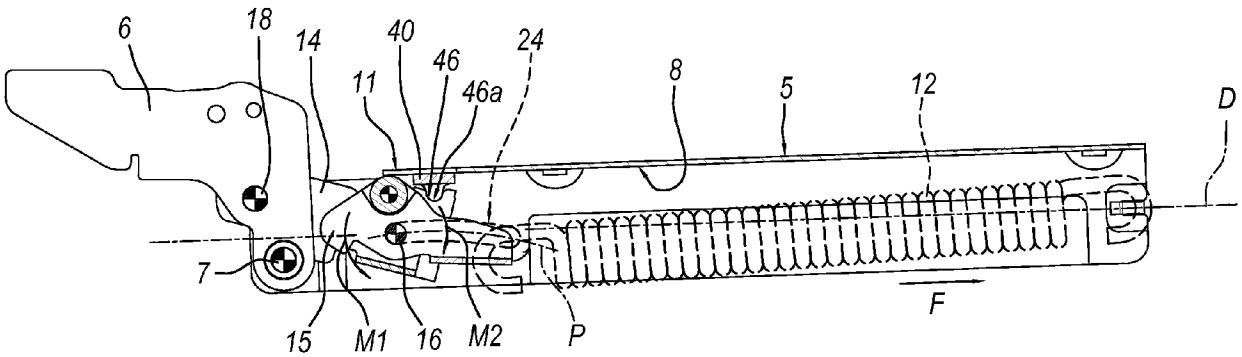
FIG. 9 is a side view, with some parts cut away in order to better illustrate others, of a variant embodiment of the hinge of FIG. 2.

It should be noted that the slots 26, and in particular, their profiles, define the open position of the door 3. In effect, when being opened, the door 3 stops turning when the slidable pivot pin 16 comes into contact with the third, joining stretch 30 of each slot 26. By preventing the pin 16 from sliding further, the third stretch 30 prevents further turning of the door 3 in the opening direction (FIG. 9).

With reference to FIG. 3, the hinge 4 comprises a blocking unit 32 which locks the lever 6 and the box-shaped body 5 at the closed position of the door 3.

The blocking unit 32 comprises a roller 33 mounted on the tie rod 15 and engaging a cam profile 34 formed on the lever 6. The roller 33 and the cam profile 34 are kept in the engaged state by the action of the spring 12 acting directly on the tie rod 15. The tie rod 15 is subject to a momentum M1, caused by the action of the spring 12 about an axis of rotation defined by the pivot pin 16, so that the roller 33 is brought into contact with the cam profile 34 of the lever 6, when the door 3 is in the proximity of the closed position.

Looking in more detail, the roller 33 is mounted on the tie rod 15 by way of a pin 35, supported at the ends of it by the side walls 23 of the tie rod 15. On the other hand, the cam profile 34 formed on the lever 6 has a first stretch 36 and a second stretch 37 which are engageable in succession by the roller 33 during the rotation of the door 3, and hence of the lever 6 relative to the box-shaped body 5, towards the closed position.

The first stretch 36 is engageable with the roller 33 when the door 3 comes near the closed position, and its shape is such as to convert the action of the spring 12 into torque which opposes the rotation of the door 3 in the closing direction.

The second stretch 37 is engageable with the roller 33 when the door 3 reaches the closed position, and its shape is such as to reinforce the action of the spring 12 in order to restrain the door 3 in that position.

Furthermore, a blocking element 38 (FIG. 2) is pivoted to the lever 6 to allow the door 3 to remain in a partly open position, for example, to remove it from the frame 2 of the oven 1. The blocking element 38, which rotates about a respective pin 51, engages an edge 39 of the above mentioned aperture 11 of the box-shaped body 5, thereby preventing the spring 12 from causing the door 3 to rotate towards the closed position.

As shown in FIGS. 3, 4, 5 and 9, the hinge 4 also comprises a shoe 40 which is interposed between the connecting rod 14 and the box-shaped body 5 and which is slidable on the bottom wall 8 of the box-shaped body 5 when the door 3 is being opened and closed.

Figure 7:
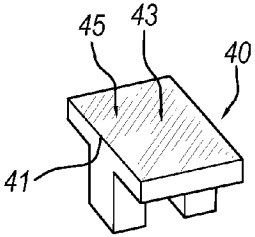
FIGS. 6 and 7 are perspective views showing a first variant embodiment of a component from FIG. 2.
Figure 6:
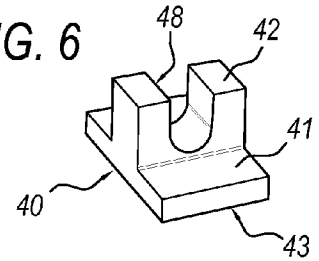

The shoe 40 has a first portion 41 and a second portion 42 (FIGS. 6 and 7).

The first portion 41 (FIG. 7) has a flat face 43 which defines a surface for contact with the bottom wall 8 of the box-shaped body 5 to allow shoe 40 to slide on the bottom wall 8.

By means of the second portion 42 (FIG. 6) the shoe 40 is connected to the connecting rod 14. More specifically, the second portion 42 forms a rotoidal connection between the shoe 40 and the connecting rod 14. This allows the shoe 40 and the connecting rod 14 to rotate relative to each other, guaranteeing contact between the shoe 40 and the bottom wall 8 of the box-shaped body 5 when the door 3 is being opened and closed.

Figure 5:
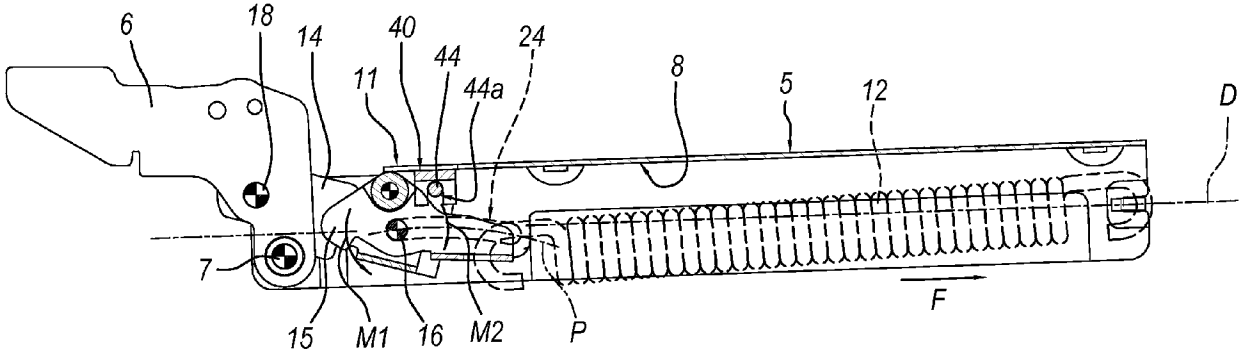

In a first variant embodiment, shown in FIGS. 3 to 5, the connecting rod 14 has two side walls 21. A pin 44, having a cylindrical surface 44*a*, is supported at the ends of it by the side walls 21. The second portion 42 of the shoe 40 is substantially in the shape of a C (FIG. 6), forming a seat 48, which engages the cylindrical surface 44*a* of the pin 44 in such a way as to allow the shoe 40 and the connecting rod 14 to rotate relative to each other.

Figure 8:
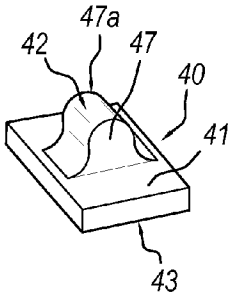
FIG. 8 is a perspective view showing a second variant embodiment of the component of FIGS. 6 and 7.

In a second variant embodiment, shown in FIG. 9, the connecting rod 14 has two side walls 21, each having a seat 46. More specifically, each of the seats 46 has a cylindrical surface 46*a*. The second portion 42 of the shoe 40, on the other hand, comprises a protrusion 47 which engages each of the seats 46 and which has a cylindrical surface 47*a* which engages with each cylindrical surface 46*a* of a respective seat 46 in such a way as to produce the relative rotation between shoe 40 and connecting rod 14 (FIG. 8).

The shoe 40 is made of a plastic material with a low friction coefficient. Advantageously, this reduces the friction of the shoe 40 sliding on the bottom wall 8 of the box-shaped body 5, which is made preferably of a metallic material. This embodiment is advantageous, for example, compared to an embodiment in which the shoe 40 is made of a metallic material.

As described in more detail below, the shoe 40 is capable of forcing the pivot pin 16 to travel along the above mentioned predetermined path P in the slots 26, relieving them of the stress caused by the sliding action of the pin 16 itself.

The hinge 4 comprises graphical and/or color signs 45 constituting recognition means for identifying the type of spring 12 fitted.

These recognition means are useful, for example, during maintenance operations, to immediately identify the model of hinge 4 fitted, and in particular, the type of spring 12 fitted and, hence, the force applied by the spring. In effect, when the hinge 4 is fitted, the box-shaped body 5 hides the spring 12 which means that the type of spring cannot be identified unless the hinge 4 is removed completely.

More precisely, the graphical and/or color signs 45 are applied to the fiat face 43 of the shoe 40 (FIG. 7).

The signs 45 are visible when the door 3 is being opened because the shoe 40 slides with the tie rod 15 and the connecting rod 14 towards the end of the box-shaped body 5 where the first pin 7 is so that it partly faces the aperture 11 of the box-shaped body 5.

Below is a description of how the hinge 4 according to the invention works.

When the door 3 is in the closed position, the spring 12 is compressed and applies on the lever 6 a torque which keeps the door 3 in the closed position (FIG. 3).

The force F applied by the spring 12, produces rotation of the tie rod 15 anticlockwise about the pivot pin 16 in the drawing plane of the figure, so as to keep the roller 33 in contact with the second stretch 37 of the cam profile 34 of the lever 6. Thus, the door 3 is held in the closed position.

When the door 3 is being opened, the roller 33 is disengaged from the second stretch 37 and gradually brought to the first stretch 36 as the door 3 is made to rotate (FIG. 4).

During rotation of the door 3 towards the open position, the spring 12 is pulled and elongated, which further increases the intensity of the elastic reaction force F, preventing the weight of the door 3 from causing the door itself to open too quickly and suddenly.

Also, when the door 3 is being opened, the tie rod 15 and the connecting rod 14 tend to move towards the first end 10 of the box-shaped body 5. This movement is made possible by the slots 26 of the box-shaped body 5 and by the sliding of the pivot pin 16 coupled thereto.

Generally speaking, during the rotation of the door 3, in both the opening and closing directions, the pivot pin 16 produces stress on the slots 26, which eventually leads to wear of the slots 26 themselves.

Wear of the slots 26 causes the roller 33 to incorrectly engage the cam profile 34, especially when the door 3 is moved from the open to the closed position.

Consequently, there is the risk of the door 3 opening spontaneously because the blocking unit 32 is no longer able to hold the door 3 in the closed position.

More in detail, what happens is that one or more portions of the profile of the slots 26 become worn. More precisely, the part exposed to the heaviest wear is the first stretch 28 of the profile 27 of each slot 26.

The stress on this stretch is caused by pressure exerted by the pivot pin 16 as it slides, as a result of the elastic reaction force F generated by the spring 12 acting on the connecting rod 14 and on the tie rod 15.

Owing to the elastic reaction force F exerted by the spring 12, the pivot pin 16 tends to remain in contact with the first stretch 23 of the profile 27 of the respective slot 26. Thus, the wear of the slots 26 causes the pivot pin 16 to be displaced in the direction of the bottom wall 8 of the box-shaped body 5.

The tie rod 15 is also subject to the same displacement as that which the pin 16 undergoes.

As a result of the displacement of the pin 16, and hence of the tie rod 15, the roller 33 no longer correctly engages the cam profile 34 because the roller 33, which is integral with the tie rod 15, is forced to undergo the same displacement towards the bottom wall 8 of the box-shaped body 5.

In order to overcome this problem, therefore, the hinge 4 of his invention is provided with the above mentioned shoe 40.

As mentioned previously, the shoe 40 forces the pivot pin 16 to follow the predetermined path P within the slots 26 in such a way as to limit the friction between the pin 16 and the profile 27 of the respective slot 26.

With reference to a single slot 26, by "predetermined path" is meant the trajectory followed by the pivot pin 16 within the slot 26, so that the pin 16 exerts on the slot 26 sufficient pressure to guarantee contact while it slides but at the same time preventing this contact pressure from reaching the excessively high values which would cause frictional wear on the slot 26.

In other words, when the door 3 is being opened and closed, the reaction force F generated by the spring 12 subjects the tie rod 15 to a momentum about the pivot pin 16 which tends to press the pin 16 against the profiles of the slots 26, in particular against the first stretch 28.

This momentum increases the contact pressure between the pin and the slots 26, thereby increasing the friction between the pin 16 and the slots 26.

The increase in the friction may reach excessively high values, such as to eventually lead to wear of the slots 26, with the consequences mentioned above.

The shoe 40, therefore, reacts to the momentum M1 generated by the spring 12 and in turn generates a momentum M2 opposite in direction, which prevents the pin 16 from exerting excessively high pressure on the slots 26, thus limiting the friction between the two.

The hinge 4 described above brings numerous advantages.

First of all, the adoption of a shoe 40 interposed between the box-shaped body 5 and the connecting rod 14 constitutes a simple solution in terms of construction.

Moreover, the shoe 40 does not limit, or reduce the efficiency of, the movement and interaction of the different components.

The functionality of the hinge 4 is enhanced because, as explained, the friction between the pin 16 and the slots 26 is considerably reduced.

Furthermore, a shoe 40 made of plastic material reduces the friction caused by sliding on the bottom wall 8 of the box-shaped body 5, which is made preferably of a metallic material, compared to using a shoe 40 made of metal.

As a whole, the hinge 4 has a reduced number of components and this aspect of it accordingly reduces its manufacturing and maintenance costs.

Also, the hinge 4 can be quickly removed from its housing in the frame 2 of the oven 1 and from the door 3 and, besides, once the hinge 4 has been removed, the different parts are easy to access.

The use of graphical and/or color signs 45 facilitates maintenance operations because it allows immediate identification of the model of the hinge 4, based in particular on the type of spring 12 fitted and on the force applied by the spring. That also means less time and expense for substituting and/or repairing the hinge 4 because the hinge 4 does not need to be removed completely to identify the type of spring 12 fitted.

The invention described above is susceptible of industrial application. It can be adapted and modified in several ways without thereby departing from the scope of the inventive concept. Moreover, all the details of the invention may be substituted by technically equivalent elements.

What is claimed is:

1. A hinge for doors of domestic appliances such as ovens, dishwashers or the like, comprising:

a lever;

a box-shaped body comprising a bottom wall and two side walls;

the lever and the box-shaped body being hinged to each other through the agency of a first pin to make the lever and the box-shaped body tiltable relative to each other, the lever and the box-shaped body being fixable one to a frame and the other to a door, for making the door movable relative to the frame between an open position and a closed position;

an elastic mechanism located at least partly inside the box-shaped body for producing an elastic reaction force which opposes the opening of the door;

a connecting rod hinged to a first end of the lever;

a tie rod hinged to the connecting rod and connected to the elastic mechanism;

a pivot pin for tie rod and connecting rod, slidable with its ends in respective guides formed in the side walls of the box-shaped body when the door is opened and closed, the hinge being characterized in that it comprises a shoe interposed between the connecting rod and the box-shaped body, slidable relative to the bottom wall when the door is opened and closed, in order to force the pin to travel along a predetermined path in the guides and to limit friction between pin and guide, thus avoiding guide wear.

2. The hinge according to claim 1, wherein the shoe comprises a first portion having a flat face which defines a surface for contact with the bottom wall of the box-shaped body during the sliding of the shoe.

3. The hinge according to claim 2, wherein the shoe comprises a second portion which is in rotoidal connection with the connecting rod.

4. The hinge according to claim 3, where the connecting rod comprises two side walls, the hinge further comprising a pin, having a cylindrical surface and supported at the longitudinal ends thereof by the side walls; the second portion being substantially C-shaped, for engaging the pin, the second portion having a seat for engaging the cylindrical surface of the pin in such a way as to produce the relative rotation between shoe and connecting rod.

5. The hinge according to claim 3, wherein the connecting rod comprises two side walls, each having a seat with a cylindrical surface; the second portion of the shoe having a protrusion with a cylindrical surface which engages with the cylindrical surface of each of the seats in such a way as to produce the relative rotation between shoe and connecting rod.

6. The hinge according to claim 1 wherein each of the guides is defined by a slot formed on the respective side wall of the box-shaped body.

7. The hinge according to claim 1, comprising a mechanism for recognizing the model of the hinge and the type of elastic mechanism mounted.

8. The hinge according to claim 7, wherein the recognition mechanism comprise graphical and/or color signs on the flat face of the shoe.

9. The hinge according to claim 1, wherein the shoe is made of a plastic material with a low friction coefficient.

* * * * *